United States Patent [19]

Aizawa

[11] 4,346,878

[45] Aug. 31, 1982

[54] SHEET FEEDING APPARATUS

[75] Inventor: Masahiro Aizawa, Tokyo, Japan

[73] Assignee: Ricoh Company, Ltd., Tokyo, Japan

[21] Appl. No.: 133,093

[22] Filed: Mar. 24, 1980

[30] Foreign Application Priority Data

Apr. 9, 1979 [JP] Japan ..... 54-42749
Apr. 9, 1979 [JP] Japan ..... 54-42750

[51] Int. Cl.[3] ..... B65H 3/06; B65H 1/14
[52] U.S. Cl. ..... 271/118; 271/127
[58] Field of Search ..... 271/118, 127, 117, 114, 271/116, 156

[56] References Cited

U.S. PATENT DOCUMENTS 3,265,384 8/1966 Shute ..... 271/118 X
4,025,066 5/1977 Sue ..... 271/127 X
4,180,319 12/1979 Kaufmann et al. ..... 271/118 X

FOREIGN PATENT DOCUMENTS 533254 8/1931 Fed. Rep. of Germany ..... 271/118

*Primary Examiner*—Bruce H. Stoner, Jr.
*Attorney, Agent, or Firm*—Wyatt, Gerber, Shoup, Scobey & Badie

[57] ABSTRACT

In sheet feeding apparatus capable of feeding copy sheets individually from a stack of copy sheets held in a sheet feeding cassette to an exposure station of a copying machine, an improved sheet feeding apparatus comprises a cassette, a bottom plate for stacking copy sheets, which is disposed in the cassette, a sheet feeding roller which is disposed above the stack of copy sheets and rotates at the time of sheet feeding, a bottom plate driving mechanism for moving the bottom plate upwards and downwards, bringing the upper surface of sheets into pressure contact with the sheet feeding roller by moving the bottom plate upwards when feeding the copy sheets individually, and moving the bottom plate downwards after each sheet feeding. Furthermore, the sheet feeding apparatus comprises a mechanism for rotating the sheet feeding roller by use of the driving force for moving upwards and downwards the bottom plate.

9 Claims, 13 Drawing Figures

SHEET FEEDING APPARATUS

BACKGROUND OF THE INVENTION

The present invention relates to a sheet feeding apparatus of cassette type for use in copying machines.

In a conventional electrophotographic copying machine, a sheet feeding roller, which is disposed above a cassette, is brought into pressure contact with a leading edge portion of the top sheet of a stack of sheets held in the cassette, and the sheet feeding roller is rotated. At the same time, the sheets are individually separated from the stack of sheets and fed into a predetermined portion by corner separators bringing the leading edge portions of the top sheet upwards elastically. In this sort of conventional sheet feeding apparatus, a stack of sheets is placed on a bottom plate disposed in a cassette and the bottom plate is elevated by rotating a buttom plate pushing member receiving the bottom plate, with one end of the bottom plate being a fulcrum for the elevation of the bottom plate, so that the top sheet of the stack of sheets is brought into contact with the sheet feeding roller, with a predetermined pressure and friction necessary for shifting and feeding the sheets individually from the stack of sheets. In this sheet feeding apparatus, a top portion of the pushing member can enter and retract from a hole of the bottom of the cassette. When the cassette is detached from and attached to the copying machine, the top portion of the bottom plate pushing member is retracted from the cassette, and at the same time, the bottom plate is moved downwards, so that the upper surface of the sheet is released from the pressure contact with the sheet feeding roller.

However, in the conventional sheet feeding apparatus, normally, that is except when the cassette is attached or detached, the upper surface of the sheet is in pressure contact with the sheet feeding roller and such condition may last for a long time. In particular when the ambient humidity is high, a sort of wave is formed in a portion of the stack of sheets in contact with the sheet feeding roller. When the sheets are deformed like this, each sheet does not contact uniformly and closely with a photoconductor, in the case of a electrophotographic copying machine, and consequently the image is not transferred uniformly from the photoconductor to each sheet, with untransferred portions being left behind, and other problems may occur. In an electrophotographic copying machine of direct image formation type using zinc oxide coated photosensitive paper, a zinc oxide layer which constitutes the uppermost layer of the zinc oxide coated photosensitive paper may be scratched by the sheet feeding roller and the trace of the scratch may be left on the copy image. As the pressure of the sheet feeding roller applied to the sheet and the time for the sheet feeding roller to be in pressure contact with the sheet increase, the scratch may become conspicuous. Furthermore, in the conventional sheet feeding apparatus, since the above-mentioned bottom plate pushing member is retracted from the cassette whenever the cassette is detached from the copying machine, a troublesome lever operation from the outside of the copying machine is required.

SUMMARY OF THE INVENTION

A sheet feeding apparatus according to the invention is provided with a sheet feeding roller; a sheet feeding cassette; a bottom plate for stacking sheets thereon, which is movable upwards and downwards and is disposed in the cassette; a bottom plate pushing member for moving the bottom plate upwards and downwards; and drive means for swinging the bottom plate pushing member intermittently.

The intermittent drive means comprises, for example, a clutch mechanism for connecting and disconnecting the transmission of a driving force between a driving force input side and a driving force output side; a cam disposed at the output side; a cam follower; and a transmission member for transmitting the movement of the cam follower to the bottom plate pushing member.

The intermittent drive means rotates the bottom plate pushing member in the direction for moving the bottom plate upwards whenever sheets are fed individually by the rotation of the sheet feeding roller, and brings the sheet feeding roller into pressure contact with the upper surface of the sheets, and retracts the bottom plate pushing member in the direction for moving the bottom plate downwards when sheets are not fed.

According to the invention, the sheet feeding roller is brought into pressure contact with the upper surface of sheets only when the sheets are fed, and the time for the sheet feeding roller to be in contact with the sheets does not last long. Therefore, deformation of the sheets can be prevented, and in the case of electrophotographic copying machines of the type of transferring visible images to sheets, image transfer can be performed uniformly, without untransferred portions being left.

Furthermore, since the sheet feeding roller does not contact with sheets for a long time, scratching of the upper zinc oxide layer of zinc oxide coated photosensitive paper can be prevented or reduced significantly in the case of electrophotographic copying machines of direct image formation type.

Furthermore, according to the invention, unlike the conventional sheet feeding apparatus, the lever operation for making the bottom plate pushing member enter the cassette or retracting the same from the cassette becomes unnecessary in order to attach the cassette to and detach the same from the copying machine.

Therefore, it is an object of the invention to provide a sheet feeding apparatus which does not have the conventional shortcomings and which does not require any particular operation when detaching the sheet feeding cassette.

DETAILED DESCRIPTION OF THE PREFERRED EMBODIMENT

Figure 1:
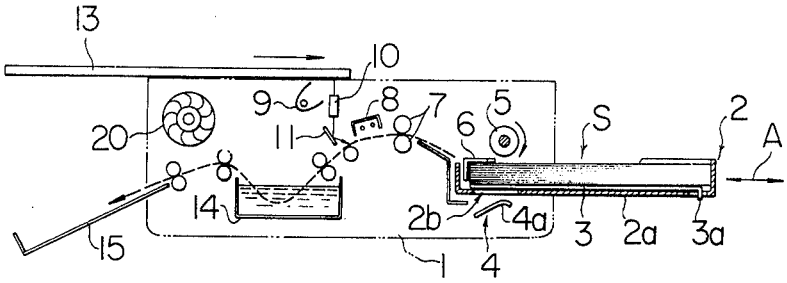
FIG. 1 shows diagrammatically an electrophotographic copying machine of direct image formation type for explaining the use of the invention.

Referring to FIG. 1, there is shown an example of a direct type electrophotographic copying machine to which the invention can be applied. In FIG. 1, a sheet feeding cassette 2 is detachable from a copying machine 1 in the direction of the arrow A. Inside the cassette 2, there is disposed a bottom plate 3 which can be turned about a base end 3*a* thereof which is bent in the shape of a hook. In a bottom portion 2*a* of the cassette 2, there is formed a rectangular opening 2*b* through which a top portion 4*a* of a bottom plate pushing member 4 can enter the cassette 2 as will be explained in more detail. The bottom plate pushing member 4 serves to turn and move upwards the bottom plate 3 so as to bring an upper leading edge portion of a top sheet of a stack of sheets S placed on the bottom plate 3 into pressure contact with a sheet feeding roller 5 disposed above the cassette 2.

When the top sheet is brought into pressure contact with the sheet feeding roller 5, the roller 5 is rotated in the direction of the arrow and the top sheet is moved forwards by the friction between the roller and the top sheet, and the leading portion of the top sheet is elastically separated from the second sheet by corner separators 6 which hold the opposite corners of the sheets. The separated top sheet is then caught and transported by a pair of feed rollers 7. The surface of the sheet transported by the feed rollers 7 is charged uniformly by a charger 8. The uniformly charged surface is exposed to a light pattern by an exposure system comprising an illumination light source 9, a light condensing phototransmitter 10 and a reflector 11, whereby a latent electrostatic image corresponding to the light pattern is formed. During the exposure step, a contact glass 13 is moved in the direction of the arrow.

In the electrophotographic copying machine, as the copying paper, a zinc oxide coated sheet is used, and the latent electrostatic image formed on the zinc oxide coated sheet is developed while it is caused to pass through a liquid developer tank 14 after exposure. After the development, the sheet is dried by a fan 20 and is then discharged onto a sheet discharge tray 15. As mentioned previously, the sheet feeding roller 5 and the corner separators 6 serve to separate sheet individually from a stack of sheets and to transport the separated sheets individually into the feed rollers 7. In particular, the sheet feeding roller 5 is designed in such a manner that by a predetermined angle of rotation of the sheet feeding roller 5, one sheet is fed into the pair of feed rollers 7, and the leading edge portion of the sheet is caught by the feed rollers 7, and then the bottom plate pushing member 4 which has been pushing the bottom plate 3 upwards is retracted from the cassette 2, and consequently the upper surface of the stack of sheets is separated from the sheet feeding roller 5.

Figure 2:
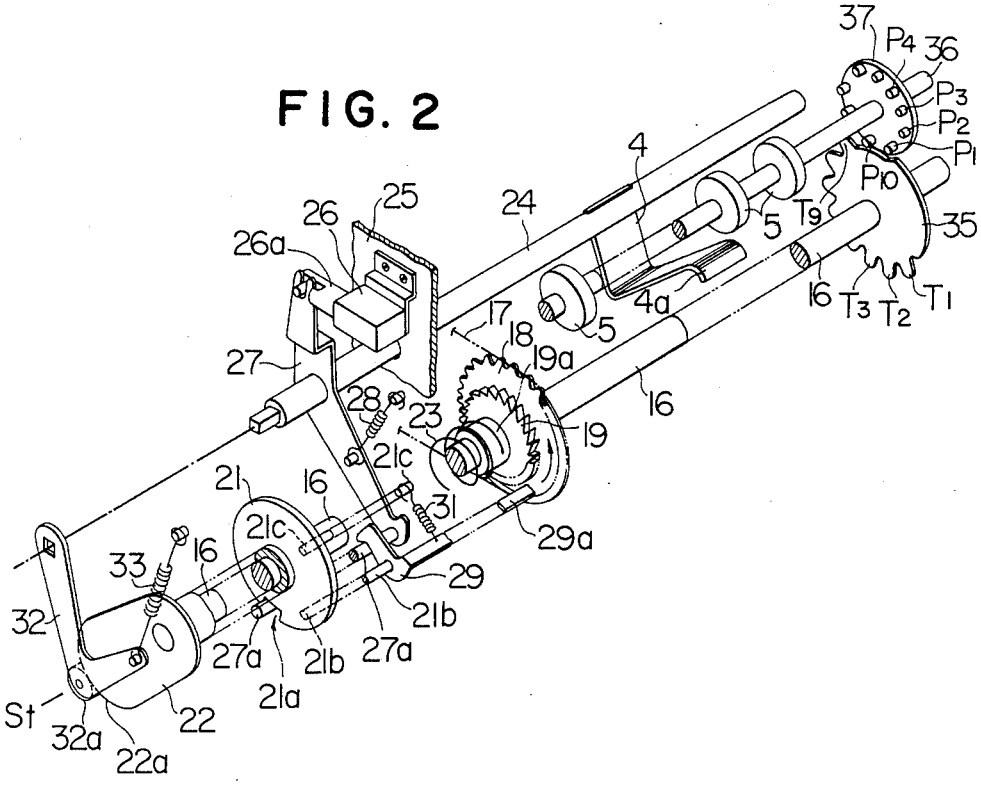
FIG. 2 shows perspectively a mechanism for swinging a bottom plate of a sheet feeding cassette and a mechanism for rotating a sheet feeding roller, which are employed in an embodiment of a sheet feeding apparatus according to the invention.

An embodiment of a sheet feeding apparatus according to the invention will now be explained more specifically referring to FIG. 2. In FIG. 2, a sprocket 18 over which a chain 17 is trained and a ratchet wheel 19 which is integral with the sprocket 18 are rotatably supported on a shaft 16 which is supported by a stationary base plate (not shown). To an end portion of the shaft 16, there are fixed a disk 21 having a notch 21*a* at its peripheral portion and an operation cam 22 (hereinafter referred to as cam 22) which is integral with the disk 21. A boss portion 19*a* of the ratchet wheel 19 is equipped with a coil spring 23 frictionally held thereon and one end of the coil spring 23 is stopped by the disk 21.

A shaft 24 is disposed parallel to the shaft 16 and is rotatably supported by a stationary base plate 25 and another stationary base plate (not shown) which is disposed so as to face the base plate 25. To the shaft 24, is supported the lower end of the bottom plate pushing member 4 and a release bar 27, whose one end is connected to a solenoid 26. In the other end of the release bar 27, there is embedded a pin 27*a* which is engaged with an edge portion of the notch 21*a* of the disc 21 by the elasticity of a spring 28. In the disc 21, there is embedded a pin 21*b* which is directed to the sprocket 18. To the pin 21*b* is secured a follower pawl lever 29. A pin 21*c* embedded in the disc 21 and the follower pawl lever 29 are connected to each other by a taut spring 31 and by the elastic tautness of the spring 31, the connecting pawl lever 29 is given a bias so as to rotate counterclockwise about the pin 21*b* in FIG. 3. The rotation of the lever 29 which may be effected by the counterclockwise bias is stopped by the pin 27*a* of the release bar 27. The base end of an arm 32 is fixed to one end portion of the shaft 24 and a cam follower 32*a* is mounted on the arm 32. To the arm 32 is given a bias so as to rotate counterclockwise in FIG. 3 by a comparatively strong elasticity of the taut spring 33, and by the counterclockwise rotating bias, the cam follower 32*a* is brought into pressure contact with the top portion of the greatest diameter cam edge of the cam 22.

Figure 3:
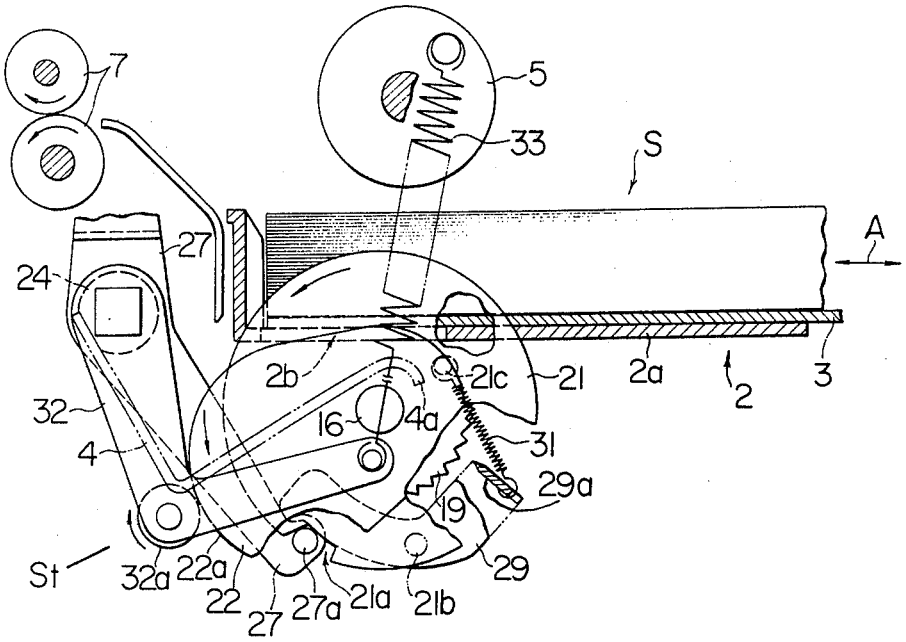
FIG. 3 shows diagrammatically an initial operation state of the embodiment of the invention.

In FIGS. 2 and 3, there is shown an initial operation position of the embodiment according to the invention. When the apparatus is in the operating position as shown in FIGS. 2 and 3 and a main switch of the copying machine is depressed, the chain 17 is driven and the sprocket 18 and the ratchet wheel 19 begin to be rotated in the direction of the arrow around the shaft 16. At this moment, the boss portion 19*a* of the ratchet wheel 19 only rotates in a slippery manner with respect to the spring 23 whose one end is fixed to the disc 21. In this case, the disc 21 tends to be rotated in the same direction as that of the ratchet wheel 19 by the friction between the spring 23 and the boss portion 19*a*, but the rotation of the disc 21 is stopped by the pin 27*a* of the release bar 27.

Figure 4:
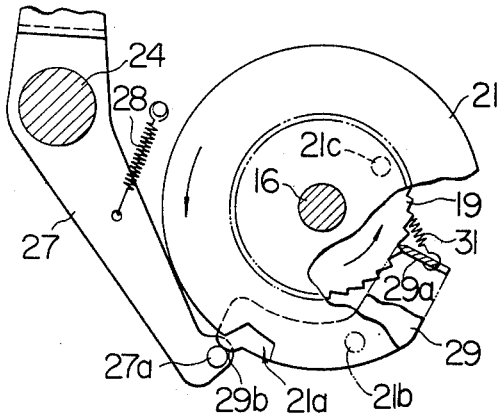
FIG. 4 shows diagrammatically a state in which a follower pawl lever engages with a ratchet wheel of the sheet feeding apparatus of FIG. 3.

When a print button of the electrophotographic copying machine is depressed under the above-mentioned condition, the solenoid 26 is energized and a plunger 26*a* of the solenoid 26 is pulled, so that the release lever 27 is rotated clockwise about the shaft 24 from the position shown in FIG. 3 to the position shown in FIG. 4 against the elasticity of the spring 28. As a result, the pin 27*a* of the lever 27 is retracted from the notch 21*a* of the disc 21, whereby the follower pawl lever 29 is rotated counterclockwise about the pin 21*b* by the elastic tautness of the spring 31 and a pawl 29*a* of the follower pawl lever 29 engages with the ratchet wheel 19 which is rotated in the direction of the arrow.

Figure 5:
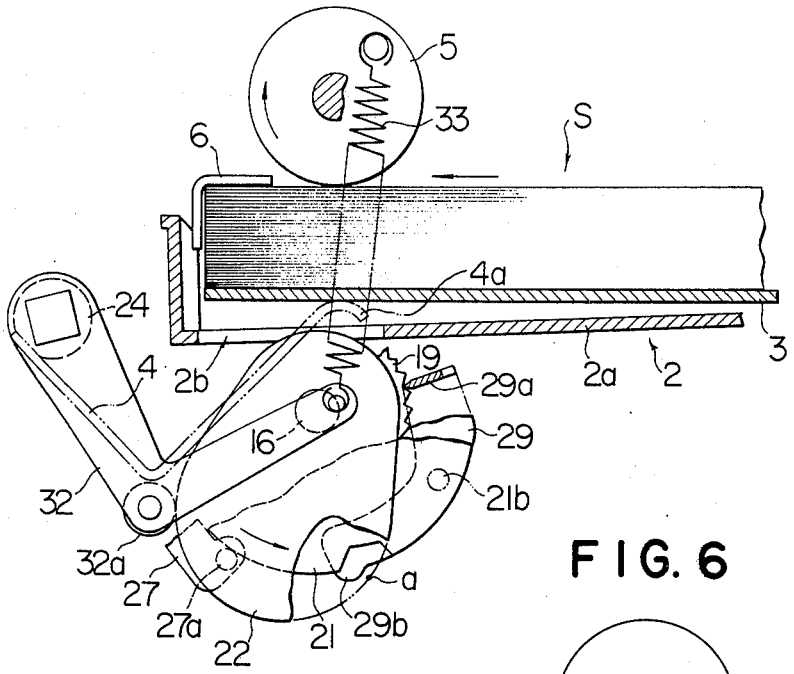
FIG. 5 shows diagrammatically a state in which the bottom plate is elevated and the upper surface of a stack of sheets is in pressure contact with the sheet feeding roller in the sheet feeding apparatus of FIG. 3.

The disc 21 and the cam 22, following the rotation of the ratchet wheel 19 through the pawl lever 29, begin to rotate from the position shown in FIG. 3 in the same direction as that of the ratchet wheel 19. At this time, the shaft 16 and the cam 22 rotate integrally. When the cam 22 is rotated, the cam follower 32*a* of the arm 32 is brought into contact with the edge of the rotating cam and is then moved to the right along the edge of the cam 22. At this moment, the arm 32 is turned counterclockwise by the elasticity of the spring 33. At the same time, the shaft 24 is also turned in the same direction, whereby the bottom plate pushing member 4 is turned counterclockwise. When the bottom plate pushing member 4 is thus turned, the top portion 4*a* of the bottom plate pushing member 4 comes into the cassette 2 through the opening 2*b* of the cassette 2 and bears against the bottom plate 3 and then pushes upwards the free end portion of the bottom plate 3 as shown in FIG. 5. As the bottom plate 3 is moved upwards, the upper surface of the leading edge portion of the stack of sheets S placed on the bottom plate 3 is brought into contact with the sheet feeding roller 5 with an appropriate pressure.

In the meantime, with the start of the rotation of the cam 22 from the position shown in FIG. 3, the pin 27*a* of the release lever 27 shown in FIG. 4 climbs a projected portion 29*b* of the pawl lever 29 and then drops onto the peripheral surface of the disc 21 and thereafter peripheral surface rotates while in contact with the pin 27*a*.

When the cam 22 rotates up to the position shown in FIG. 5 and further rotates therefrom, the cam edge is gradually separated from the cam follower 32*a*. FIG. 5 shows the state in which the cam follower 32*a* is going to be relatively separated from the cam edge. This separating position differs depending upon the height of the stack of sheets S. For example, when the sheets run out or when only one or several sheets are left on the bottom plate 3, the cam follower 32*a* is relatively separated from the cam edge in the position shown in FIG. 6.

When the cam 22 is rotated a little further from the position shown in FIG. 6, the sheet feeding roller 5 shown in FIG. 5 begins to rotate in the direction of the arrow by a mechanism which will be described later. By the rotation of the sheet feeding roller 5, the top sheet is transported in the direction of the arrow by an appropriate friction between the sheet feeding roller 5 and the top sheet, which is determined by the elasticity of the spring 33 and other factors. Then the leading edge of the top sheet is elastically separated from the stack of sheets S by the corner separators 6. The sheet is then fed into the pair of the feed rollers 7 (FIG. 3). While the sheet feeding roller 5 is rotated, the leading edge of the sheet is caught by the feed rollers 7.

Figure 6:
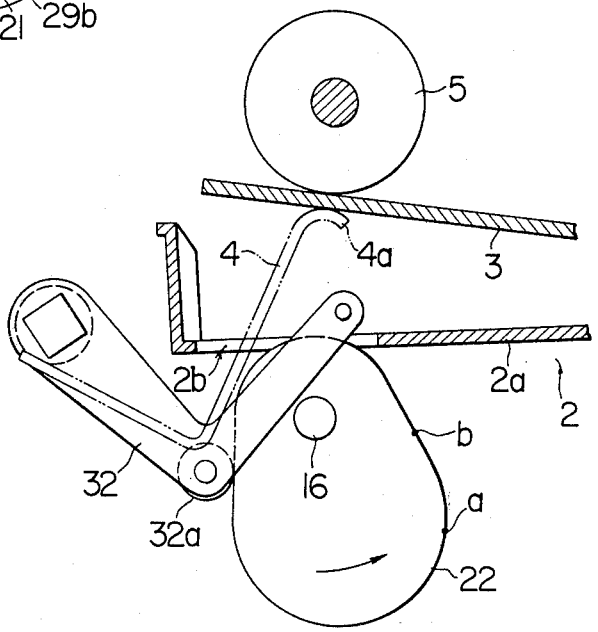
FIG. 6 shows diagrammatically the configuration of a cam and a cam follower with which the cam engages when the sheets on the bottom plate run out in the sheet feeding apparatus of FIG. 3.
Figure 7:
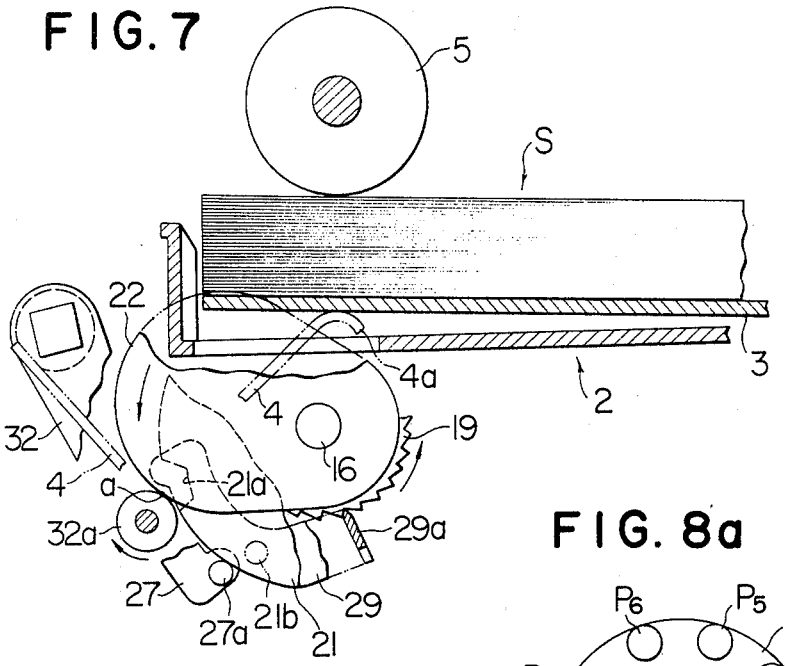
FIG. 7 shows diagrammatically the configuration of the cam and the cam follower when the bottom plate begins to be moved downwards in the sheet feeding apparatus of FIG. 3.

Even after the leading edge of the sheet has been caught by the feed rollers 7, the cam 22 rotates continuously and when a position a of the cam edge shown in FIG. 5 reaches or nearly reaches the position of the cam follower 32*a* as shown in FIG. 7, the cam follower 32*a* and the cam edge begin to contact with each other and then the cam edge pushes the cam follower 32*a* and rotates the arm 32 clockwise against the resilience of the spring 33 back to the initial position shown in FIG. 3. The above-mentioned position a is a symmetrical position in the cam 22 with respect to the contact point between the cam follower 32*a* and the cam edge. Furthermore, the position a differs depending upon the height of the stack of sheets S. For example, when the sheets run out or only several sheets or one sheet is left, the cam follower 32*a* and the cam edge begin to relatively contact with each other at a position b as shown in FIG. 6 and, after the leading edge of the sheet has been caught by the pair of the feed rollers 7, the position b reaches its opposite position of the cam follower 32*a*.

When the cam 22 is rotated from the position shown in FIG. 7 to the position shown in FIG. 3, the cam 22 makes one revolution from its initial position. While the cam 22 is rotated from the position shown in FIG. 7 to the position shown in FIG. 3, the cam follower 32*a* is pushed and moved and the bottom plate pushing member 4 is rotated clockwise and its top portion 4*a* is retracted from the cassette 2. Therefore, the bottom plate 3 is moved downwards, and the stack of sheets S is released from the pressure of the sheet feeding roller 5.

Referring back to FIG. 1, on the opposite sides of the feed roller pair 7, there are disposed sheet detection sensors (not shown). When the leading edge of the sheet is going to be detected or is detected by the sheet detection sensors, the cam 22 has been rotated to the position shown in FIG. 7 and the solenoid 26, which has been energized until that time, is deenergized by a detection signal produced from the sheet detection sensors and, at the same time, the release lever 27 is turned counterclockwise by the resilience of the spring 28 (FIG. 2). At this moment, the pin 27*a* pushes the follower pawl lever 29, which has been located at the position shown in FIG. 3, at the notch 21*a*, so that the lever 29 is rotated clockwise about the pin 21*b* and the pawl 29*a* is released from the teeth portion of the ratchet wheel 19. At the same time, the pin 27*a* engages with the notch 21*a* of the disc 21 as shown in FIG. 5. Immediately when the pawl 29*a* is departed from the ratchet wheel 19, the disc 21 and the cam 22 and other members relating thereto stop their operation at the respective positions shown in FIG. 3 and are set ready for the next copying process. When the next copying process is performed, the above-mentioned series of steps is repeated.

Referring to FIG. 2, the coil spring 23 which is frictionally wound around the boss portion 19*a* of the ratchet wheel 19, with its one end being fixed to the disc 21 and with the other end being fixed to the boss portion 19*a* has the following function: In this type of clutch mechanism, when the pawl 29*a* of the pawl lever 29 engages with the rotating ratchet wheel 19, the driven disc 24 and cam 22 may make prior revolutions. This is because the cam follower 32*a* relatively drops from the top portion of the largest diameter cam edge 22*a* and the load applied to the cam 22 decreases. When the cam 22 makes prior revolutions, the shaft 24 also makes prior revolutions and consequently the bottom plate pushing member 4 knocks up against the bottom plate 3, making noises. The coil spring 23 serves to prevent the prior rotation of the cam 22 and eliminate the above-mentioned inconvenience.

The follower pawl lever 29, the disc 21, the cam 22, the cam follower 32*a*, the release lever 27 and other members relating thereto constitute drive means for swinging intermittently the bottom plate pushing member 4*a*. Of the above-mentioned members, the follower pawl lever 29, release lever 27, disc 21 and other members relating thereto constitute a kind of clutch mechanism, which serves to connect and disconnect the transmission of rotation between the sprocket 18 on the driving side and the cam 22 on the driven side. As other clutch mechanisms capable of performing the same function, a spring clutch mechanism and a magnetic clutch can be used as well.

Thus, in the embodiment of the invention, the upper surface of the top sheet of a stack of sheets is brought into pressure contact with the sheet feeding roller 5 only when the sheet is fed from the cassette 2 and caught by the sheet feed roller pair 7, and except that particular occasion, the stack of sheets S is free from the pressure contact operation of the sheet feeding roller 5.

Referring back to FIG. 1 again, when the sheets S are moved upwards and the upper surface of the stack of sheets S is brought into contact with the sheet feeding roller 5 while the sheet feeding roller 5 is being rotated, the contact timing may vary and the fed sheet may become skew. In contrast to this, when the sheet feeding roller 5 is rotated after the upper surface of the top sheet has been brought into contact with the sheet feeding roller 5, the above-mentioned inconvience can be eliminated.

Furthermore, when the sheet feeding roller 5 is driven by utilizing the driving force for actuating the mechanism for applying the contact pressure from the sheet to the sheet feeding roller 5 and releasing the same, the driving system can be combined into one and simplified, and when the driving system is actuated in such a manner that the sheet feeding roller 5 begins to be rotated after it has been brought into pressure contact with the upper surface of the sheet, the previously mentioned shortcomings can be eliminated.

A gear 35 which lacks teeth partly (hereinafter referred to as the teeth lacking gear 35) and a driven rotating plate 37 shown in FIG. 2 perform the above-mentioned function.

In FIG. 2, to one end portion of the shaft 16, the teeth lacking gear 35 is fixed, which lacks teeth in a portion of its periphery but has teeth T1, T2, . . . T9. A shaft 36 to which the sheet feeding roller 5 is fixed is rotatably supported by a base plate (not shown) and to an end portion of the shaft 36, there is fixed the driven rotating plate 37 in which pins P1, P2, . . . P10 are embedded with an equal space therebetween in the manner as shown in FIG. 2.

The mutual driving relationship between the cam 22 and the sheet feeding roller 5 will now be explained.

Figure 8A:
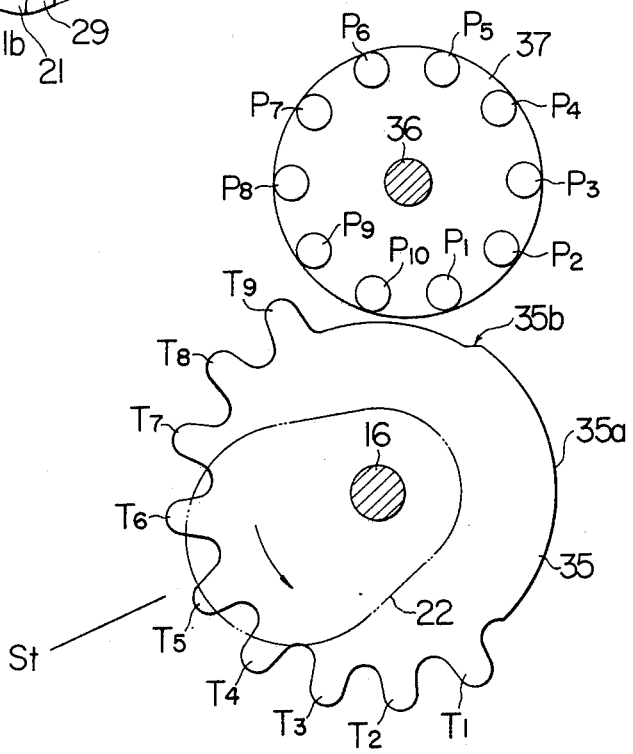
FIGS. 8*a* to 8*e* show the mutual relationship between a teeth lacking gear and a driven rotating plate which constitute an intermittent rotation transmitting means which is incorporated in the embodiment according to the invention.

Referring to FIG. 8*a*, the cam 22, teeth lacking gear 35 and driven rotating plate 37 are normally maintained in their respective initial positions shown in FIG. 8*a*. Under this condition, when the main switch of the copying machine is turned on, the sprocket 18 in FIG. 2 is rotated and when the print button is depressed, the solenoid 26 is energized, whereby the lever 29 is caused to engage with the ratchet wheel 19 and the cam 22 begins to be rotated from its initial position St in the direction of the arrow in FIG. 8*a*. At the same time, teeth lacking gear 35, which is coaxially and integral with the cam 22, also begins to be rotated in the same direction. During the rotation, a guide peripheral surface 35*a* formed in the teeth lacking portion of the gear 35 comes into light contact with the pin P10 embedded in the driven rotating plate 37. In this case, the driving force is not transmitted to the driven rotating plate 37 so that the rotating plate 37 is kept stationary, while the teeth lacking gear 35 idles.

Figure 8B:
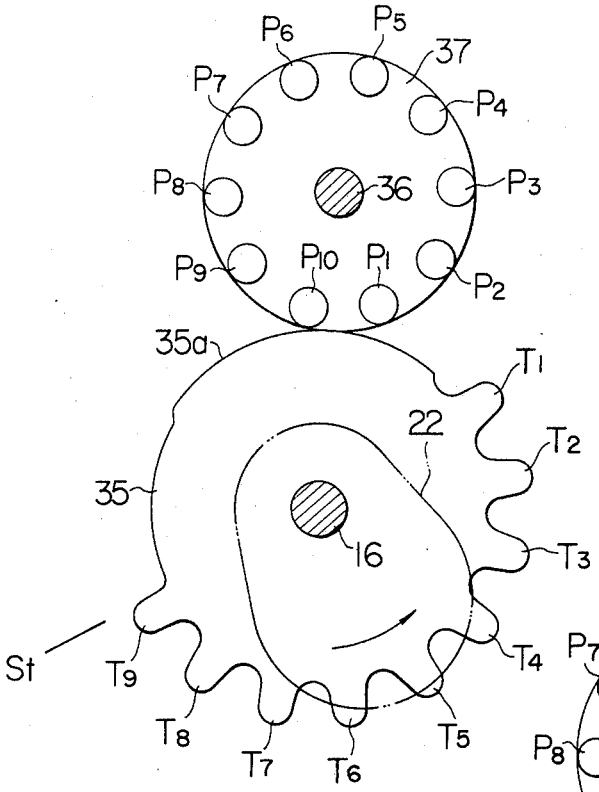

About the time when the teeth lacking gear 35 rotates from the position shown in FIG. 8*a* to the position shown in FIG. 8*b*, the elevating operation of the bottom plate 3 is completed as shown in FIG. 6. Hereinafter it is supposed that only a few sheets remain on the bottom plate 3 for the convenience of explanation. When the teeth lacking gear 35 is rotated to the position shown in FIG. 8*b*, passing the position shown in FIG. 8*a*, the first tooth T1 of the gear 35 comes to contact with the pin P1 and pushes the pin P1 to the left, so that the driven rotating plate 37 is rotated in the direction of the arrow. In other words, at that moment the rotating driving force of the teeth lacking gear 35 is transmitted to the driven rotating plate 37. The sheet feeding roller 5 begins to be rotated so that the sheets on the bottom plate 3 are individually fed.

Figure 8C:
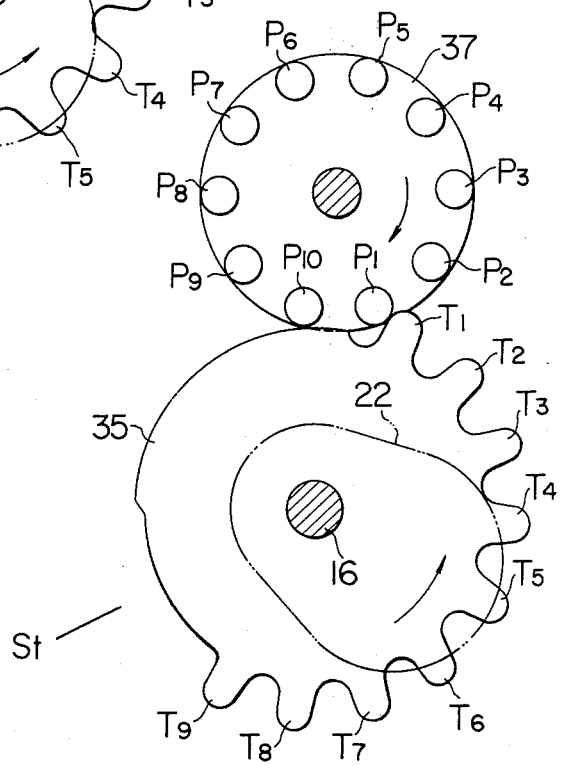

As can be seen from the above, in the teeth lacking portion of the gear 35, the rotating driving force of the gear 35 is not transmitted to the driven rotating plate 37 and during this time, the bottom plate 3 is moved upwards. When the gear 35 is rotated further to the position shown in FIG. 8*d*, the cam edge of the cam 22 comes to contact with the cam follower 32*a* and the cam follower 32*a* is pushed to the left and the bottom plate pushing member 4 which has been located in the position shown in FIG. 6 begins to be turned clockwise, so that the bottom plate 3 is moved downwards and the sheets are released from the pressure contact with the sheet feeding roller 5. By the time when gear 35 has been rotated from the position shown in FIG. 8*c* to the position shown in FIG. 8*d*, the leading edge of the sheet fed from the bottom plate 3 is caught by the feed roller pair 7. In other words, the sheets are released from the pressure contact state after the leading edge of the sheet has been caught by the feed rollers 7.

Figure 8D:
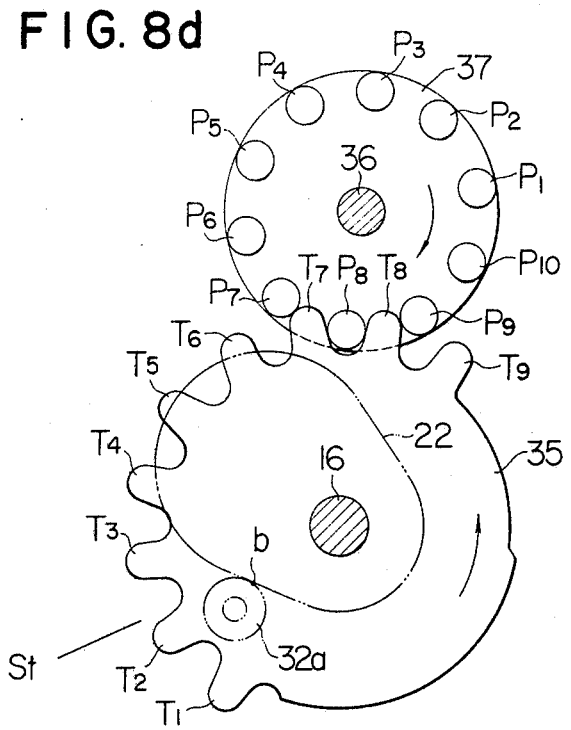
Figure 8E:
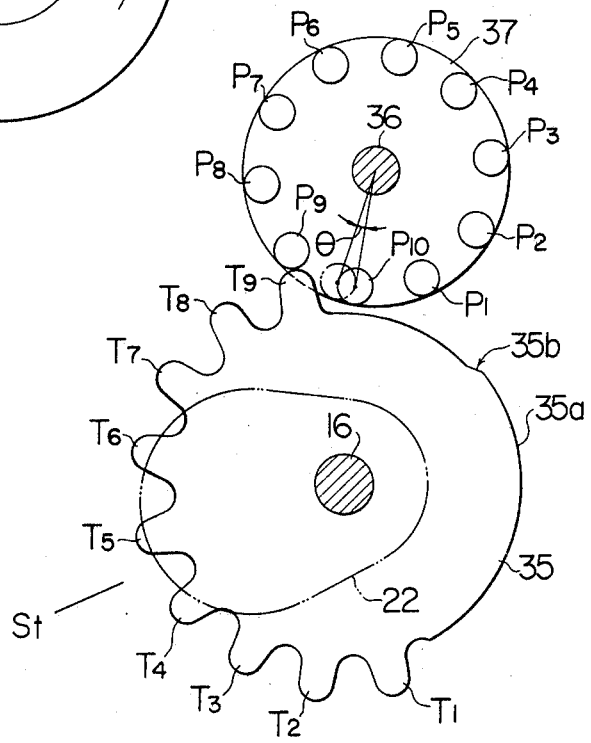

Furthermore, when the gear 35 is rotated from the position shown in FIG. 8*d* to the position shown in FIG. 8*e*, the last tooth T9 of the gear 35 is detached from the pin P9. At that moment, the rotation of the driven rotating plate 37, namely the rotation of the sheet feeding roller 5 is stopped. In other words, the driven rotating plate 37 stops its rotation in the position shown in FIG. 8*e*. In contrast, the gear 35 rotates continuously from the position shown in FIG. 8*e* to the position shown in FIG. 8*a*. At that moment, the solenoid 26 (FIG. 2) is deenergized and the gear 35 is stopped at the position shown in FIG. 8*a*.

After the gear 35 is stopped, since the teeth portion of the gear 35 does not exist in the rotating area of the pin circle of the driven rotating plate 37, the driven rotating plate 37 can idle. This is convenient, for example, when the peripheral surface of the sheet feeding roller 5 is cleaned by a dust cloth to remove paper dusts therefrom.

The driven rotating plate 37 is finally stopped at the position shown in FIG. 8*e*. At the next rotation of the gear 35, a step edge portion 35*b* of the gear 35 comes in contact with the pin P10 and pushes the same so that the driven rotating plate 37 is rotated by an angle $\theta$ and the pin P10 is brought to the position indicated by the imaginary line, that is, the position shown in FIG. 8*a*. At the position, the driven rotating plate 37 completes one revolution. When the pin P10 comes to the position of the imaginary line, the pin P10 comes to light contact with the starting position of the guide peripheral surface 35*a*. As can be seen from this, even if the driven rotating plate 37 is positioned at any rotating position, its rotating position is corrected to the position shown in FIG. 8*a* during the next rotation of the teeth lacking gear 35. In other words, the timing of starting the rotation of the sheet feeding roller 5 is constant at the time of sheet feeding.

Figure 9:
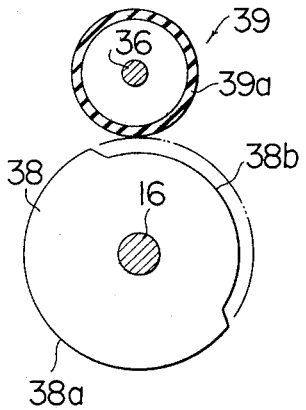
FIG. 9 shows diagrammatically another intermittent rotation transmitting means for use in the invention.

Referring to FIG. 9, there is shown an example of a rotation transmitting means for transmitting temporarily rotation from the cam shaft 16 to the sheet feeding roller shaft 36. A rotating plate 38 corresponding to the above-mentioned gear 35 has a small diameter portion 38*b* whose peripheral surface subsides except its effective peripheral portion 38*a*. The subsiding portion serves as an idling portion corresponding to the teeth lacking portion of the gear 35. Around the peripheral surface of a driven rotating plate 39 is wound a rubber ring 39*a* and, by the friction between the rubber ring 39*a* and the effective peripheral portion 38*a*, the driven rotating plate 39 is rotated. The mechanism constructed thus can attain the same performance as that of the previously mentioned mechanism.

In such an embodiment of the invention, after a predetermined pressure contact has been applied to the sheet and the sheet feeding roller 5, the sheet feeding roller 5 begins to be rotated and after the pressure contact has been released from the sheet and the sheet feeding roller 5, the sheet feeding roller is stopped. The rotation of the sheet feeding roller 5 is controlled by the temporary rotation transmitting means comprising the teeth lacking gear 35 and the driven rotating plate 37 and is characterized in that the contact pressure applying and releasing mechanism and the rotation mechanism for rotating the sheet feeding roller 5 are driven by the same drive system. Therefore, in comparison with the systems in which both mechanisms are driven by different drive systems, the construction can be simplified and the apparatus can be made compact in size.

Furthermore, since the application and release of the contact pressure and the rotation of the sheet feeding roller 5 are performed at a predetermined timing, the shortcomings such as the timing for sheet being varied can be prevented much more than in the apparatus in which the sheet is brought into pressure contact with the sheet feeding roller 5 while the sheet feeding roller 5 is being rotated.

What is claimed is:

1. A sheet feeding apparatus comprising:

a cassette for holding a plurality of sheets and including a bottom plate movable upwardly to bring said sheets into a sheet feeding position and movable downwardly to withdraw said sheets from said position;

means including a roller located above said cassette at said sheet feeding position for feeding sheets individually from said cassette;

a pushing member adapted to engage the lower surface of said bottom plate for moving said bottom plate upwardly and downwardly; and drive means connected to said pushing member for intermittently moving said pushing member in a first direction to move said bottom plate upwardly to bring said sheets into engagement with said roller and a second direction to allow said bottom plate to move downwardly to withdraw said sheets from said roller; said drive means being connected intermittently to said push member by a clutch comprising a rotating ratchet wheel, a pawl lever adapted to engage said ratchet wheel and connected integrally with a cam, means connected to said pawl lever for moving it into engagement with said ratchet wheel to cause rotation of said cam when desired to move said pusher member, and means including a cam follower engaging said cam for moving said pusher member upwardly and then downwardly upon rotation of said cam.

2. A sheet feeding apparatus as defined in claim 1, said pawl lever being connected integrally with said cam by a disc member located therebetween and connected integrally to each thereof, and further including a coil spring held between said ratchet wheel and said disc member to inhibit premature rotation of said disc member.

3. A sheet feeding apparatus as defined in claim 2, said disc member including a notch in its peripheral surface for receiving a pin movable by actuation of a solenoid for allowing said pawl lever to move into engagement with said ratchet wheel.

4. A sheet feeding apparatus as defined in claim 1, further including means connected with said roller for beginning its rotation for feeding said sheets from said cassette after said sheets have first been brought into contact with said roller.

5. A sheet feeding apparatus as defined in claim 4, said means beginning the rotation of said roller including a gear lacking teeth along a portion of its periphery, and a driven member having engaging means for engaging the teeth on said gear, said driven member being connected to said roller to rotate said roller simultaneously therewith, the teeth of said gear being arranged around a portion of the gear circumference such that said teeth engage said drive means only during the time period the uppermost of said sheets is in contact with said roller.

6. A sheet feeding apparatus as defined in claim 5, said engaging means including pins equally spaced around said driven member.

7. A sheet feeding apparatus as defined in claim 4, said means beginning the rotation of said roller including a driving member having a peripheral surface divided into a large diameter portion and a portion of smaller diameter, with a driven member adapted to engage said large diameter portion frictionally, said driven member being connected to said roller to rotate said roller simultaneously therewith, said larger diameter portion being of such a length that said driven member is rotated only during the time period the uppermost of said sheets is in contact with said roller.

8. A sheet feeding apparatus as defined in claim 1, said cassette having an opening therein for receiving said pushing member.

9. A sheet feeding apparatus as defined in claim 1, there being only a single pushing member.

* * * * *